United States Patent [19]

Binstock

[11] 4,181,099

[45] Jan. 1, 1980

[54] COORDINATED CONTROL FOR POWER PLANT FORCED AND INDUCED DRAFT FANS DURING STARTUP AND FAN SPEED CHANGES

[75] Inventor: Morton H. Binstock, Pittsburgh, Pa.

[73] Assignee: Westinghouse Electric Corp., Pittsburgh, Pa.

[21] Appl. No.: 894,074

[22] Filed: Apr. 6, 1978

[51] Int. Cl.[2] ..... F22B 37/42; F22D 5/00

[52] U.S. Cl. ..... 122/448 R; 236/15 BD; 417/28

[58] Field of Search ..... 236/14, 15 BD, 15 C, 236/1 ER; 122/448 R; 417/28, 26, 295

[56] References Cited

U.S. PATENT DOCUMENTS

| | | | |
|---|---|---|---|
| 2,499,076 | 2/1950 | Rosenberger | 417/28 X |
| 3,236,449 | 2/1966 | Brunner | 236/15 BD |

*Primary Examiner*—William E. Wayner
*Attorney, Agent, or Firm*—E. F. Possessky

[57] ABSTRACT

In a power plant, a solid state sequence is provided for starting an FD or ID fan, or for changing the fan speed in response to the position of the fan inlet vanes. The sequential process is self-calibrated since process events control the stepping operation of the sequencer. At the operating fan speed, boiler air flow and pressure are controlled by fan inlet vane position in accordance with plant load demand. When the fan speed is changed, a multiplier circuit causes the fan inlet vanes to reposition so as to minimize air flow changes as the fan speed changes. When one of multiple FD fans or multiple ID fans has its speed changed at a time a fan balancer control, which normally equalizes air flow, is biased to permit different fan flows through the different speed FD or ID fans.

15 Claims, 8 Drawing Figures

COORDINATED CONTROL FOR POWER PLANT FORCED AND INDUCED DRAFT FANS DURING STARTUP AND FAN SPEED CHANGES

BACKGROUND OF THE INVENTION

The present invention relates to electric power plant boilers and more particularly to boiler fan controls.

In electric power plants operated on the balanced draft principle, a forced draft fan (FD fan) is used to push air into the boiler for the boiler combustion process. An induced draft fan draws the outlet air or gas flow from the boiler into the chimney for discharge.

The boiler inlet and outlet air flows have to be controlled both to support combustion and to maintain a balanced draft at the operating load level while avoiding unsafe operating conditions. Too much air flow results in energy wastage while too little air flow results in a fuel rich condition which causes pollution and possibly a boiler explosion. In addition, if too much air is drawn from the boiler, a boiler trip will occur to avoid an implosion. If too little air is drawn from the boiler, the boiler becomes pressurized and dirt is blown out through small openings in the boiler structure polluting the atmosphere. To avoid these problems, the air flow is typically controlled to hold the boiler pressure at one-half inch water column, and a trip occurs if the boiler pressure swings to plus two inches or minus five inches.

Large (6000 HP or more) single speed fan motors have typically been used to drive boiler fans, and air flow has been varied by modulating inlet vanes on each FD fan as the vanes on ID fans are modulated to control boiler pressure.

More recently, large 2-speed motors have been suggested for use in controlling the FD and ID fans in order to provide better fan operating economy, lower motor inrush current on low speed startup, and safer low load operation through reduced ID fan suction potential and hence reduced implosion risk. Thus, at lower plant loads the lower fan speed can be used with substantially reduced inlet vane closure and reduced energy consumption by the fan. It is estimated that up to $40,000 or more per year can be saved by 2-speed operation of a 6000 HP fan. Further, reduced speed operation extends the time over which fans can operate before fan shutdown is required for expensive maintenance by fan blade erosion.

With the use of variable speed fan motors, special control problems are created during boiler startup and during fan speed changes. Thus, during such transient operations, steps need to be taken to avoid both boiler pressure swings or incorrect protective logic action, either of which would otherwise cause a boiler trip. For example, during the speed change, a false trip signal may be generated by measured furnace pressure excursions as the fan momentarily goes in the wrong direction during a speed change. Changing from low to high speed results in a slight loss of speed prior to high speed engagement which may cause misdirected control action and disruption of smooth plant operation. Thus, a false trip signal may also be generated when the fan is turned off momentarily to allow it to be rewired for operation at another speed; normally, the combustion control does not distinguish between such an allowable off condition from a fan trip and takes irreversible action to shed load and close isolation dampers to isolate the "faulty" fan. Further, in older boiler plants where multispeed induced draft fans are installed by retrofit, special care must be taken to protect against suction transients which could more readily cause an implosion because such older boilers typically have weaker structural designs than those of newer boiler plants.

In one partially automated control system design at the Public Service of Indiana Gibson plant, the operator initiates fan speed changes one fan at a time. A fan load balancing control is offset during the sequence of fan speed changes to allow the fans to deliver equal air flow while operating at different speeds without trying to drive them to the same inlet vane position.

The FD or ID fan speed drops when it is selected for a speed change and air flow drops or air pressure increases causing a corrective fan vane positioning action. Once the fan speed transient ends, the corrective vane positioning could result in a flow or pressure overshoot which would trip the plant if it is large enough. Such overshoots are avoided by a compensating vane control operative during fan speed changes to avoid process overshoot errors of this kind.

A balance normally makes the inlet vanes of both ID fans or both FD fans equal in an attempt to balance or equalize the air flow from the two fans when the fans are at the same speed. When the fans are at different speeds, the balance generates a bias to allow the faster fan to have a more closed vane position which results in equalized air flow.

Because of the strict safety and reliability requirements for boiler controls, it is desirable that boilers having two-speed fans be equipped with a fully automated control with protection against key equipment failure and with self-calibrating and self-checking capabilities for reliability.

SUMMARY OF THE INVENTION

A system for operating at least one forced draft fan and/or at least one induced draft fan in a power plant boiler wherein an electric motor is provided to drive each fan, said system comprising speed switching means for operating each motor at least at a low speed and at a high speed, means for controlling the position of inlet vanes associated with each fan to control the boiler air flow and pressure in response to plant load demand, means for sensing inlet vane position, and sequential logic control means for operating said speed switching means to provide orderly and smooth changes in fan speed in response to said inlet vane position sensing means at predetermined vane positions.

DESCRIPTION OF THE PREFERRED EMBODIMENT

Figure 1:
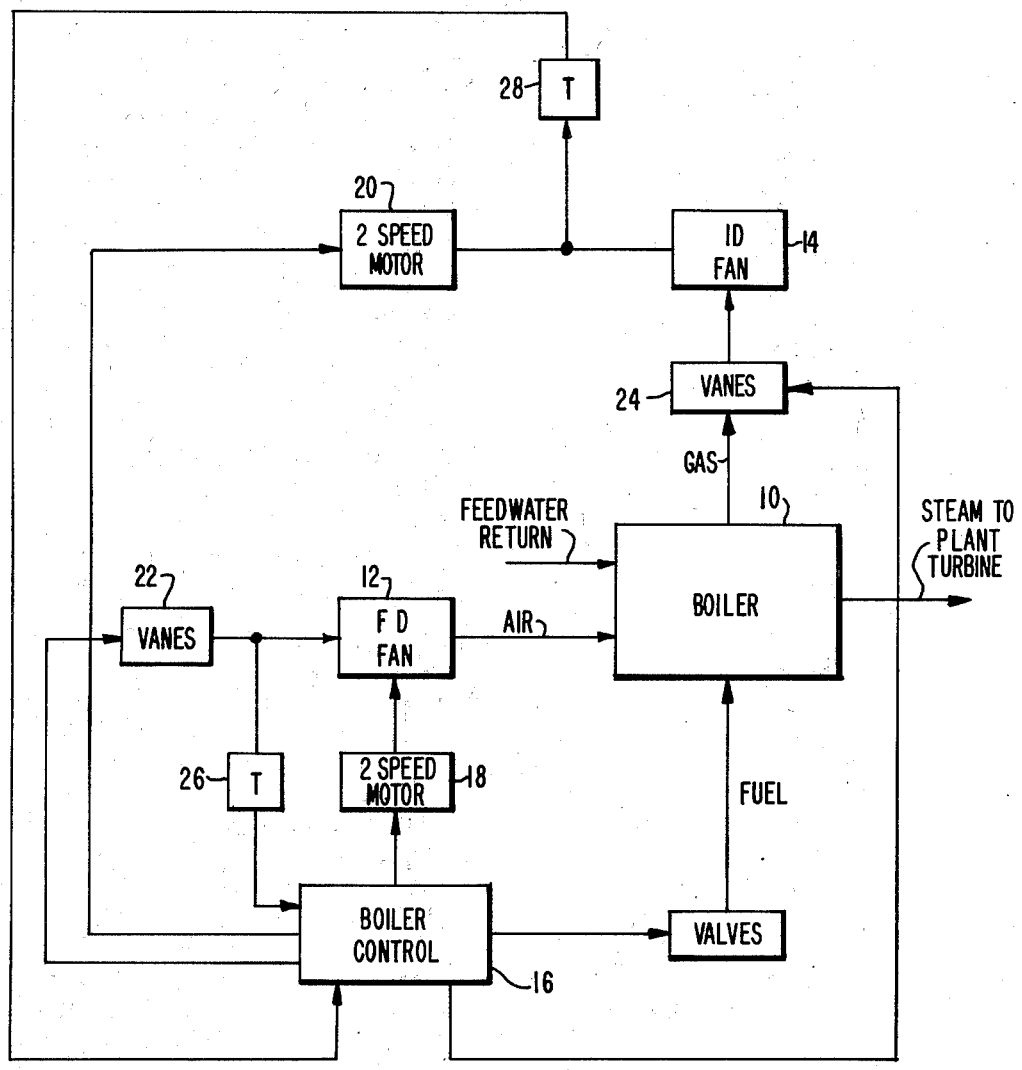
FIG. 1 shows a block diagram of an electric power plant arranged in accordance with the principles of the invention.

In FIG. 1 there is shown a boiler 10 which adds heat to feedwater and supplies steam to a turbine (not shown) in an electric power plant. The heat is generated by combustion of a fuel such as pulverized coal or oil, and the air needed for combustion is supplied by a plurality of forced draft (FD) fans 12 (only one shown). A plurality of induced draft (ID) fans 14 (only one shown) draw gases from the boiler 10. A boiler control 16 provides the fuel, water and air control needed for plant startup and load operations. As a major part of the air control, the boiler control operates respective 2-speed motors 18 and 20 for the FD and ID fans 12 and 14 and positions FD inlet vanes 22 and ID inlet vanes 24. Respective tachometers 26 and 28 are used in the control operations as described more fully subsequently.

Figure 2A:
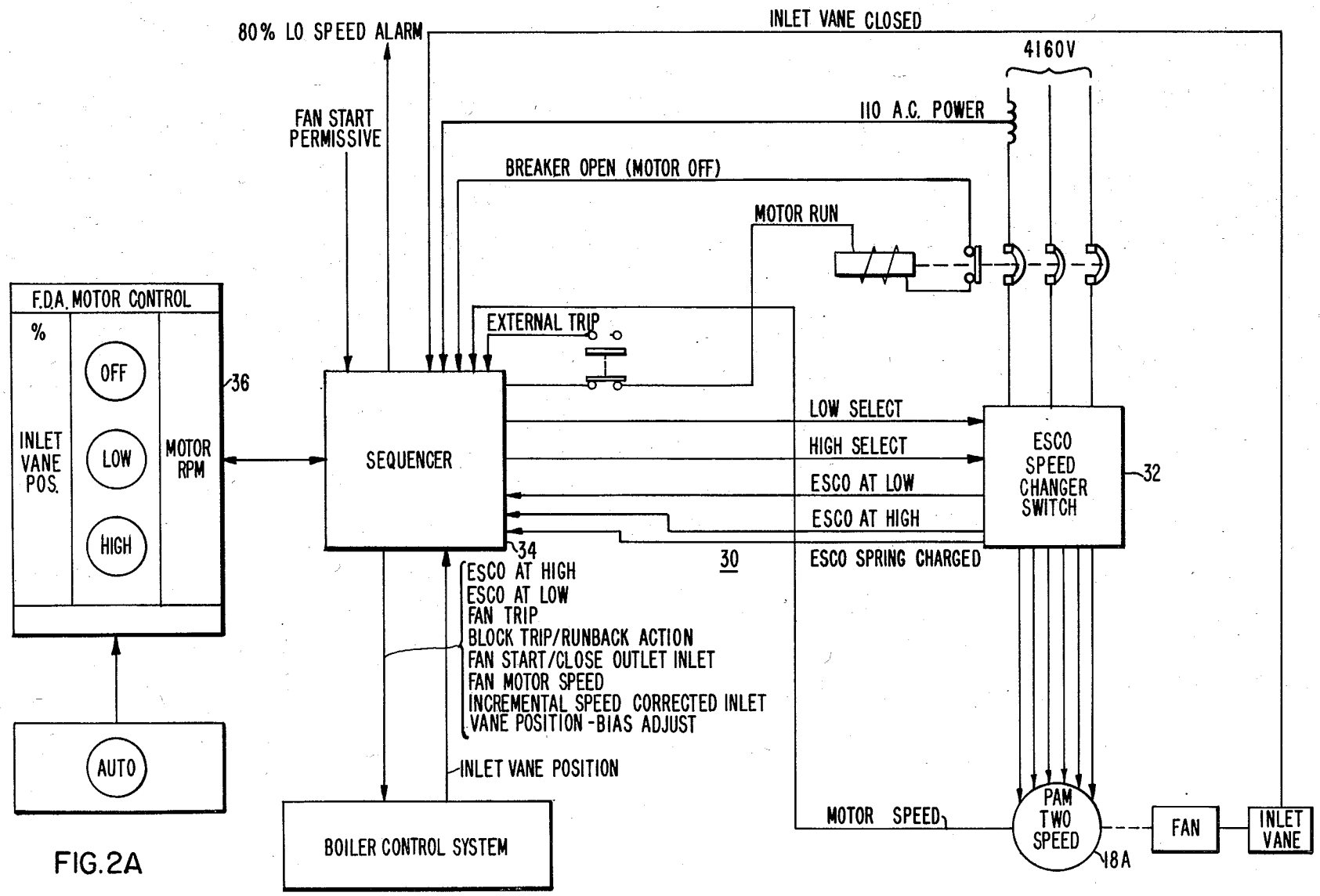
FIG. 2A shows a fan motor speed sequence control system employed in one embodiment of the invention.
Figure 2B:
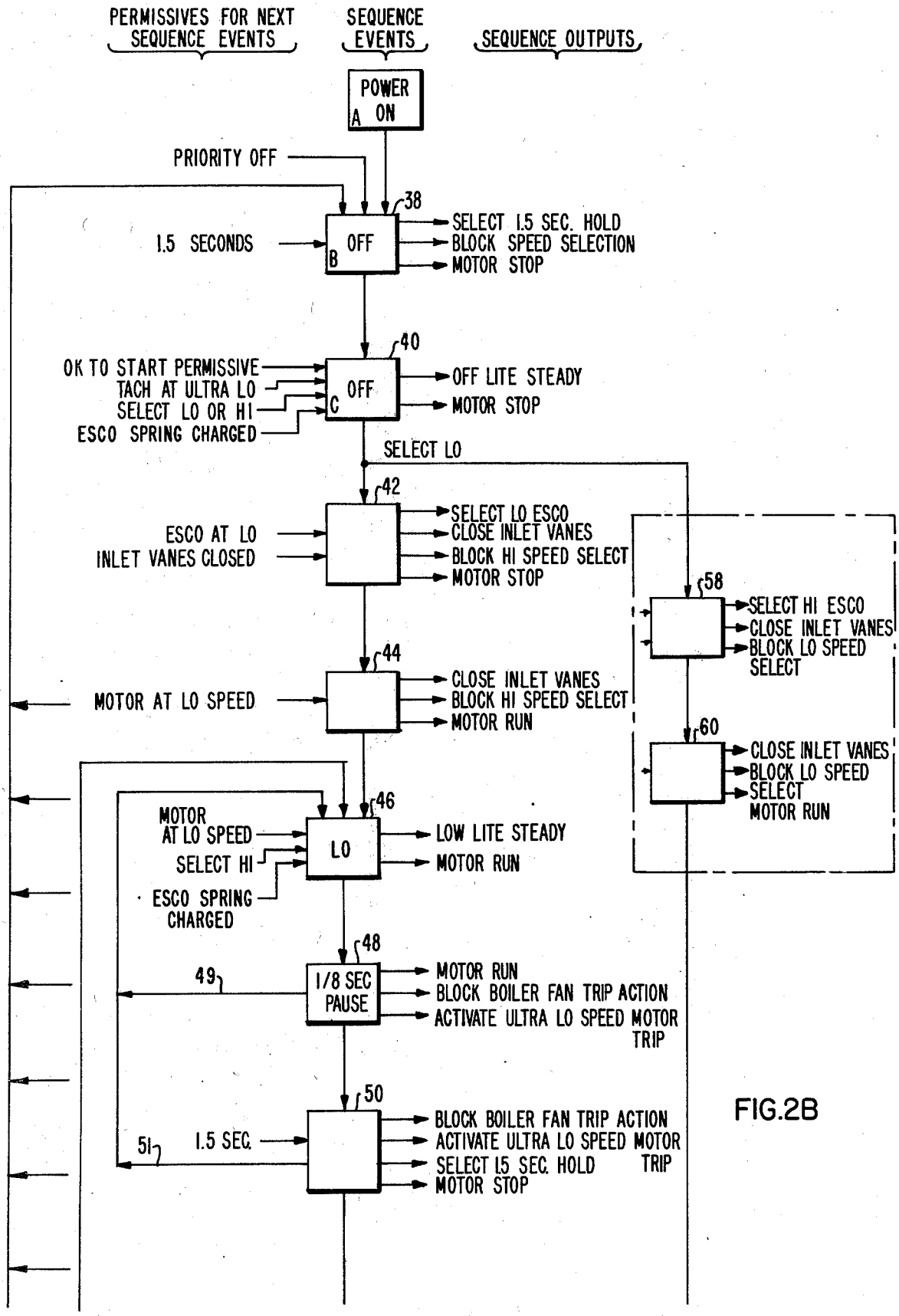
FIGS. 2B and 2C show a sequential control flow chart for a sequencer shown in FIG. 2A.
Figure 3:
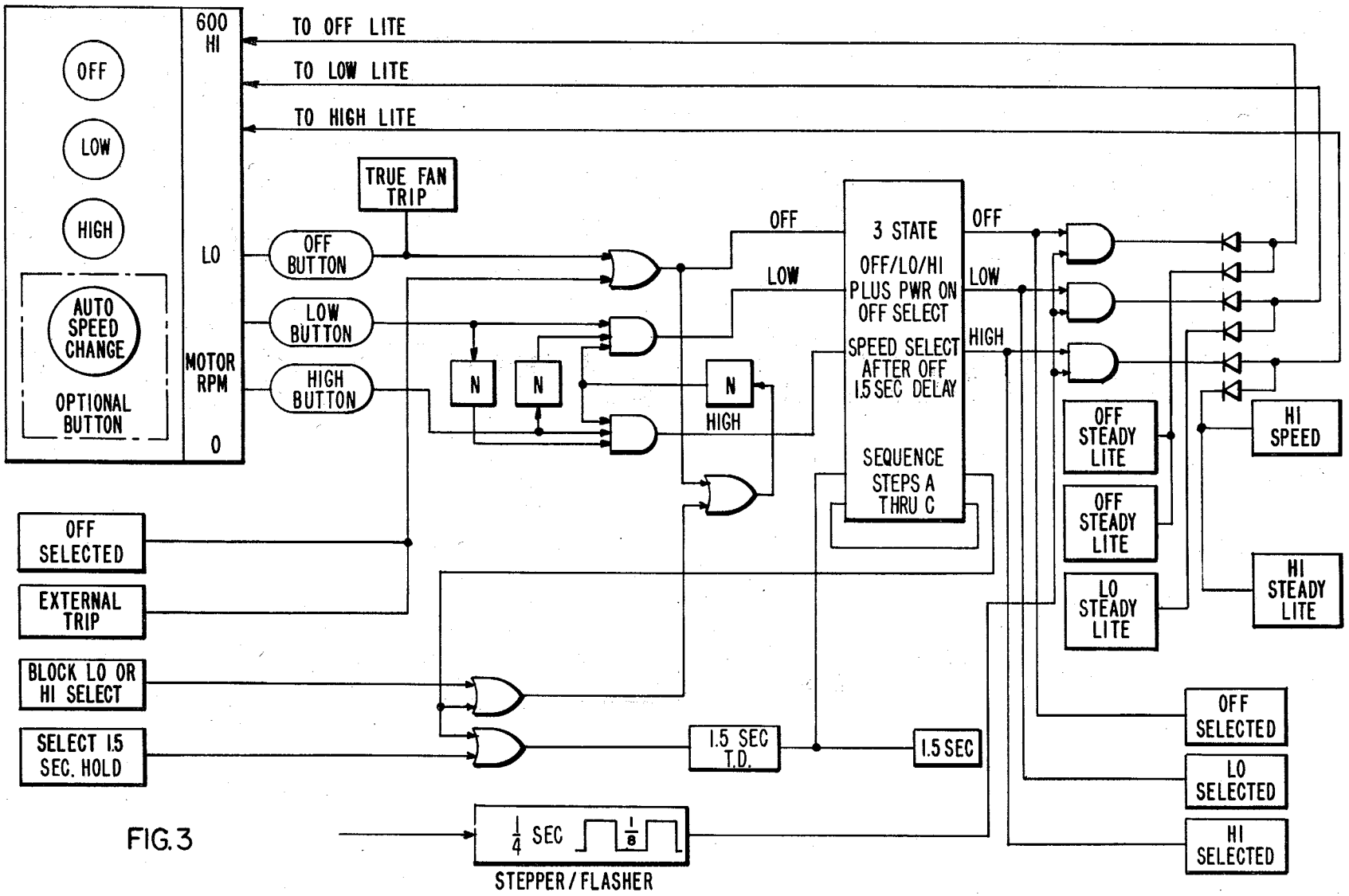
FIG. 3 shows circuitry employed to supervise the initiation of motor speed changes.
Figure 4:
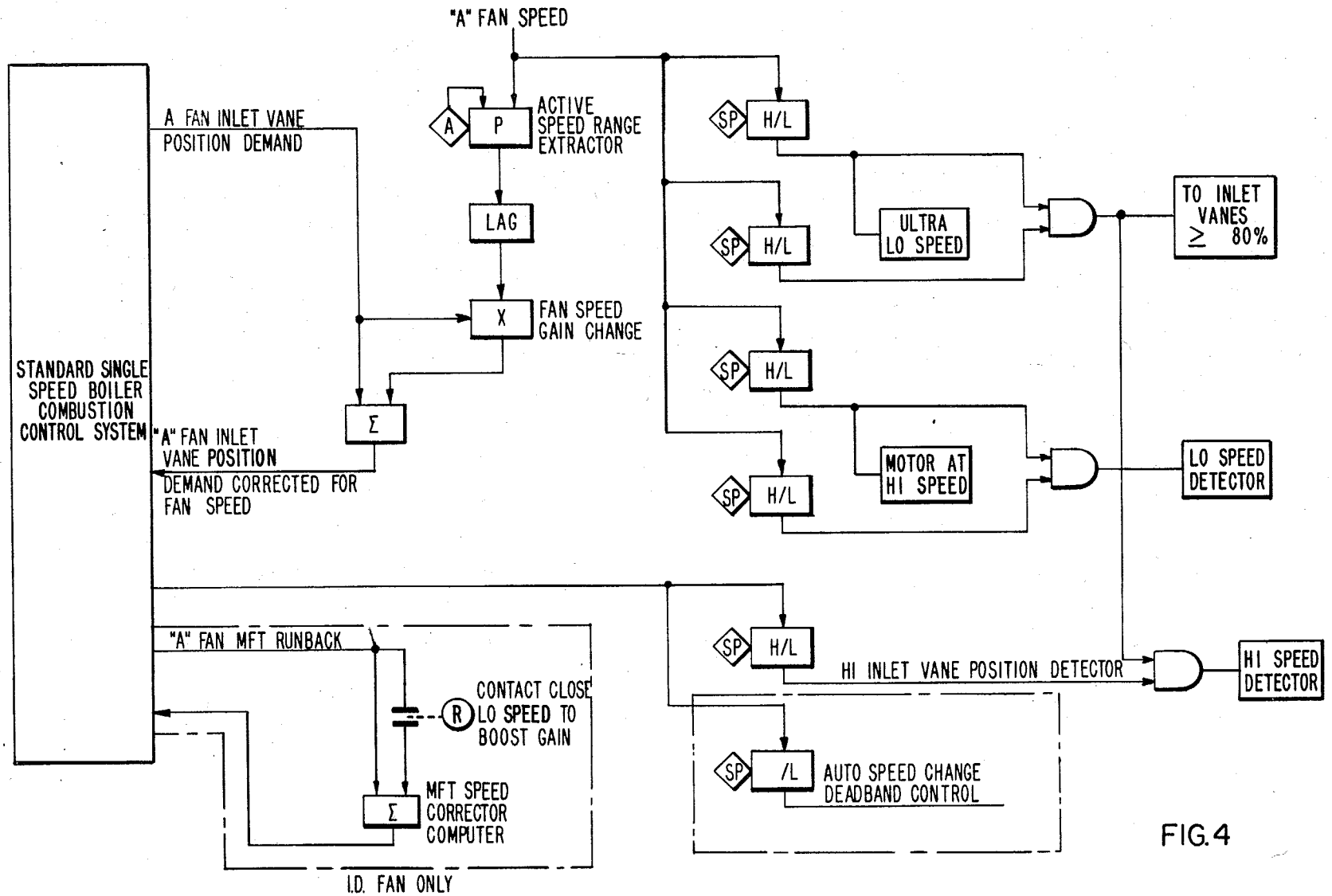
FIG. 4 shows a block diagram of an analog boiler control in greater detail.

As shown in FIG. 2A, a speed control 30 is provided for each multispeed fan motor 18 or 20. In this case, the motor is a two-speed motor commercially known as a PAM motor which is sold by Westinghouse Electric Corporation. A conventional ESCO speed changer switch 32 is operated by a solid state sequencer 34 to start and stop the motor and to switch it from one speed to the other. In turn, the sequencer either automatically switches the fan motor speed when the fan inlet vanes reach a predetermined position under air flow control by the boiler control, or an operator initiates motor speed switching action from an operator panel 36 when inlet vane position is displayed. FIG. 3 shows details of ciruitry interfacing the panel 36 and the sequencer 34.

Figure 2C:
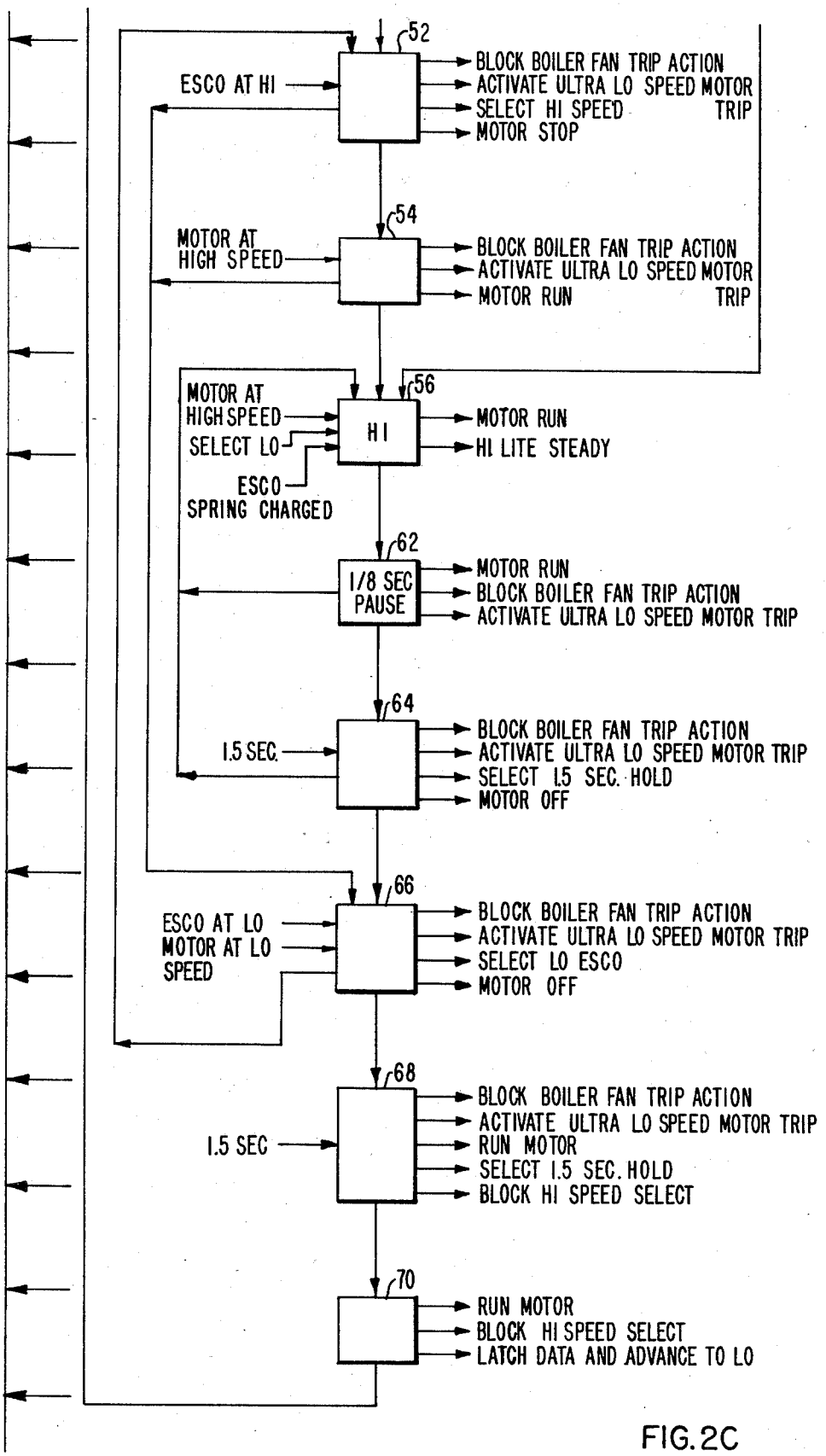

The fan speed control sequential logic is shown in the flow diagram in FIGS. 2A and 2C. The signals to the left of the sequence event blocks are inputs which operate as permissives for advancing to the next block in the sequence. The signals to the right of the step blocks are control and indicator outputs.

On startup, blocks 38 and 40 generate a motor stop output, until the indicated permissives including a HI or LO select are generated. Once the sequence is initiated toward low or high motor speed, the advancement from one step to the next is essentially self-calibrating, i.e., the use of fixed timing is avoided and intelligence is acquired from the controlled process to define when the next step is to be sequenced.

The low speed configuration of the speed changer switch 32 is selected by the output selection signal from block 42. In addition, the inlet vanes 22 or 24 are closed to allow startup and a high speed select is blocked. Under self-calibration, the sequence advances to block 44 when input signals indicate the switch 32 is configured for low speed and the inlet vanes are closed. In block 44, the motor is allowed to run up to low speed before opening of the vanes and the sequence advances to block 46 when an input signal shows that the motor is at low speed. So long as the motor remains at low speed, block 46 operates a low speed indicator light.

Generally, the motor is started with the inlet and outlet vanes closed to take the load off the motor. The sequencer waits as the motor is accelerating until it is up to speed and the sequencer then steps to ON and releases the inlet vanes to automatic control and opens the outlet vanes. The controls are all self-calibrating as the vanes are released by a motor event, i.e., when the motor reaches operating speed.

If a SELECT HI signal is generated under manual or automatic motor speed control, if the ESCO spring is charged, and if the tachometer indicates the motor is at low speed (i.e., tachometer tests out), the sequence advances to block 48 where a ⅛ second pause is taken to allow generation of a signal to block a boiler fan trip and a signal to activate an ultra low speed motor trip. Otherwise, the boiler control would sense that the motor is tripped during its temporary stopping. Next, in block 50, a 1.5 second hold is initiated as a motor stop signal is generated.

If, after the ⅛ second pause in block 48 or the 1.5 second hold in block 50, the required outputs are not generated, an abort can be initiated as indicated by line 49 or 51 and the sequence is returned to block 46 for a retry on the speed change without the boiler process itself being tripped or upset in any way. The abort can be triggered by operator selection during the hold, or, as here, it can be automatically triggered by the absence of the required outputs.

Once the hold is over and the motor is cleared for high speed, rewiring the sequence advances to block 52 where, during the motor stoppage, motor speed begins to drop as the motor windings are rewired through the switch 32 to provide for high speed operation. Once the switch 32 is rewired for high speed, block 54 reenergizes the motor to move it to the high speed at which time block 56 operates a high speed indicator lamp. The ultra low speed trip is employed as a backup protection in the event the motor continues to lose speed after switching to high speed and during the blockage of the fan trip.

Direct sequencing to high speed operation in block 56 can occur via blocks 58 and 60 from block 40. Logic similar to that in blocks 42 and 44 is used in blocks 58 and 60.

If low speed is selected manually or automatically while the motor is at high speed, blocks 62 and 64 respectively provide a pause and a hold with an abort loopback, as in case of blocks 48 and 50. In the next block 66, a low speed signal is generated to rewire the motor for low speed through the switch 32. After a coastdown of about 10 to 15 seconds with the motor off, the motor reaches low speed and the sequence is triggered to block 68 for a 1.5 second hold as the ultra low speed trip is set and as the motor is reenergized. Monitoring the coastdown speed and reenergizing just when low speed is reached provides a smooth transfer without any process disturbance. An engagement made too soon results in dynamic motor braking which causes severe motor strains and process upsets. Block 70 next runs the motor and returns the process to the low speed block 46 previously discussed.

If problems occur which prevent successful transfer to low speed, loopback is provided from block 66 to block 52 to allow an orderly abort back to high speed. If problems occur which prevent successful transfer to high speed, a forward bypass loop is provided from block 52 or 54 to block 66 to allow an orderly abort back to low speed. As shown in the drawing, a return can be selectively or automatically made to the OFF block 38 from any step in the sequence.

Under manual control the sequence advances in accordance with operation of the OFF, LOW and HIGH push buttons on the panel 36. In automatic control, fan startup is automatic and changeover from one speed to the other occurs in response to predetermined inlet vane position. For example, switchover to high speed could be made at 80% vane open position and switchover to low speed could be made at 60% vane open position.

In operation, the fan control provides for smooth and self-calibrated automatic fan speed changes reliably and repeatedly with reduced process disturbance. Fan speed changes are made as a function of inlet vane position to provide significant improvement in plant operating economy.

The boiler control includes various subsystems which are coordinated to supply fuel, air and water to the boiler so that outlet steam is supplied at the desired temperature and throttle pressure. Thus, as fuel changes are made to satisfy changing energy demands on the plant, inlet air and water changes are made coordinately by the boiler control. The air control subsystem thus varies fan vane positions to regulate air flow and pressure as a function of plant load demand and in addition as a function of fan speed changes made at any particular plant load. The invention is characterized with certain features involving the relationship of the fan control and the air control.

Figure 5:
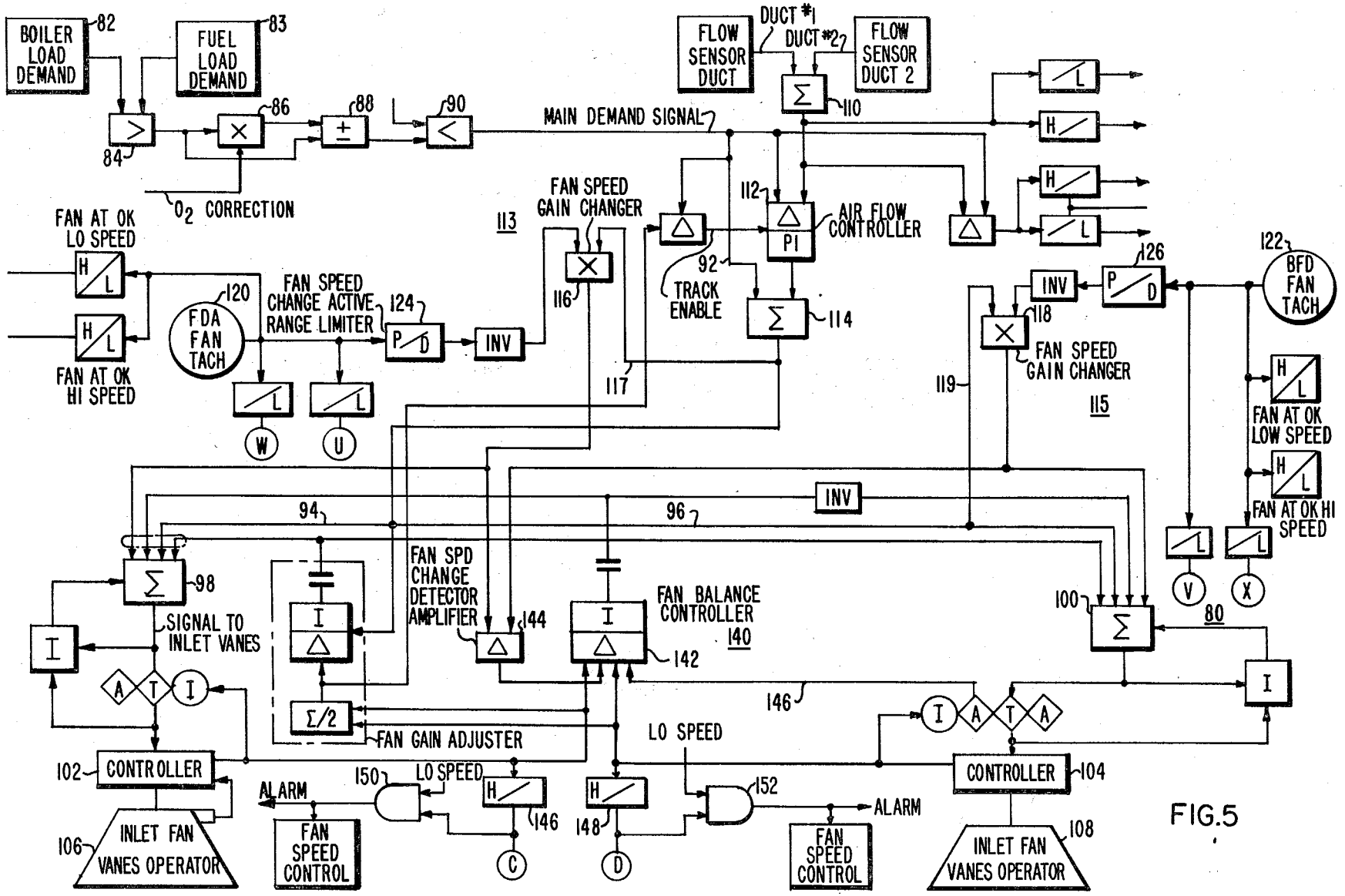
FIG. 5 shows a furnace air control used in the illustrative embodiment.

An air flow control portion 80 of the air control subsystem is shown in greater detail in FIG. 5. Boiler load demand 82 and a fuel load demand 83 are applied to a high selector 84. The high selected load demand is next adjusted for measured oxygen in the plant stacks by blocks 86 and 88, and block 90 limits the air flow to a minimum of 30% rated.

The load demand is applied as a feedforward signal over lines 92, 94 and 96 to summer 98 and 100 which operate respective position controllers 102 and 104 for the forced draft inlet vane operators 106 and 108. In turn, the position of the FD inlet vanes controls the combustion air flow into the boiler at the existing operating speeds of the respective FD fans.

The load demand and a signal from summer 110 are applied to a flow controller 112 which trims the feedforward load demand in summer 114 in accordance with the error between the demand and the actual air flow.

The FD fans in this case have a high speed of 515 rpm and a low speed of 450 rpm. If a fan speed change is initiated manually or automatically, it is desirable that actual air flow not be significantly disturbed at the existing plant load level to avoid a disturbance in plant electrical output. Thus, in a subsystem 113 or 115 for adjusting air flow demand for fan speed, a multiplier 116 or 118 is employed as a gain changer to modify inlet vane position demand when fan speed changes occur. For example, at a load operating level with a steady load demand signal, a fan speed increase would result in greater air flow and a process load disturbance which ultimately would have to be corrected by adjustment of the load demand through load feedback trim. With operation of the gain changers 116 or 118, process load disturbances are substantially avoided on fan speed changes because inlet vanes are moved as fan speed is changed anticipatorily to avoid air flow and load changes.

The summer 98 or 100 has its inputs scaled during calibration so that the load demand signal on lines 94 and 96 is scaled down to a predetermined value, in this case to the 90% level which is satisfactory for the relatively narrow operating fan speed range. The input signals to the summer 98 or 100 from the multiplier 116 or 118 are scaled to the 10% level so that the total load demand on the summer 98 or 100 is 100% when no gain adjustment is required at low speed.

When fan speed is changed from low to high, the output from a tachometer 120 or 122 indicates the change to a speed change active range limiter 124 or 126 which includes a lag factor to retard step signal changes resulting from possible tachometer failures and further operates to generate a limited range of outputs corresponding to the normal operating speed range of the fan. In this way, gross tachometer failures are prevented from causing erroneous 100% gain changes which would otherwise lead to severe process disturbances affecting the power generation.

The gain changer 116 or 118 multiplies the fan speed feedback signal against the load demand from line 117 or 119. At low fan speed, a system gain of unity results at the summer 98 or 100, i.e., the output from the multiplier 116 or 118 results in a load demand change at the 10% level. When fan speed is changed to the high speed, the speed feedback signal is increased to a value that results in a system gain of 0.9, i.e., the output from the multiplier 116 or 118 drops to zero and the summer 98 or 100 thus reacts only to the main load demand signal which, as previously noted, is scaled down to 90%.

At intermediate fan speed values, gains intermediate to 1 and 0.9 are operative as a result of appropriate precalibration of the circuitry. Thus, with increasing fan speed provision is made for correspondingly reducing inlet vane position to maintain constant inlet air flow to avoid air flow errors that would otherwise result. The opposite occurs on fan speed decreases including those instances during which fan speed drops briefly as the fan motor is turned off during switch reversing required for a fan speed change from low to high or from high to low. It is also noteworthy that anticipatory air flow adjustment for fan speed changes operates on a self-calibrating basis in the sense that vane position adjustments depend only on fan speed and not on changes in motor speed change rates, i.e., those due to motor aging or due to plant operation at different load points.

A fan balancer 140 is another air flow circuit subsystem which interacts with fan speed changes. Thus, a fan balance controller 142 normally compares fan vane position signals from the vane controllers 102 and 104 and generates an output to the summers 98 and 100 to adjust the respective vane position demand to equality on the basis of any feedback difference between them.

Normally, the speed of only one fan is changed at any one time because of the heavy electrical demand produced by the large fan motors. Therefore, during a change in speed for one fan, the balancer 140 is inhibited from calling for vane position equalization that would otherwise work at cross purposes with the fan speed gain changer 116 or 118 during a fan speed change.

In particular, a fan speed change detector 144 compares the outputs of the fan speed gain changers 116 and 118, and when a difference occurs, a bias signal is applied to the fan balance controller 142 which offsets the then allowable difference in vane positions as indicated by feedback signals from the controllers 102 and 104. If desired, a bias signal similarly can be applied to the fan balance controller 142 from an M/A station to provide for manual operator offset to the fan balancer control.

To provide for fan speed changes as a function of vane position during load control operation of the plant, respective high signal indicators 146 and 148 indicate when the inlet vanes have reached 80% open position. If the fan is at low speed and 80% vane position is reached as indicated by AND circuit 150 or 152, an alarm occurs for manual switching to high speed and the fan speed control is triggered to initiate an automatic fan speed change by the sequencer 34 (FIG. 2A) if the automatic mode has been selected.

In a manner similar to that described for the air flow control employed with the FD fans, a pressure control develops inlet vane position demand for the induced draft fans to hold a slightly negative furnace pressure as a function of load demand. Measured pressure error is used to trim the load demand and ultimately the vane position demand. Anticipatory changes are made in ID vane position as ID fan speed is changed with the employment of a fan speed gain changer arrangement like that described for the air flow control. ID vane balance control is likewise offset for differential inlet vane adjustments caused by a speed change for one ID fan but not the other.

A power plant installation could have as many as four or more fans; 2FD and 21D. If fan speed change is on automatic and all fans reach their speed change point simultaneously, it is desirable to have only one fan change its speed at any one time.

In accordance with the present invention, multiple 2-speed fan controls are interrelated such that only one fan change can occur at a time. The controls in FIG. 6 show two fans in a system with a delay interval (three minutes in this case) allowed between speed changes for the two fans.

A delay interval provides three functions. First, it prevents any one fan motor from undergoing excessive heating from cycling between high and low speed as only one change per power plant per three minutes is allowed. The three-minute delay also prevents overheating of the power distribution system resulting from the current inrushes during a fan speed change. Lastly, the three-minute delay allows the operator to monitor the results of each fan speed change.

Figure 6:
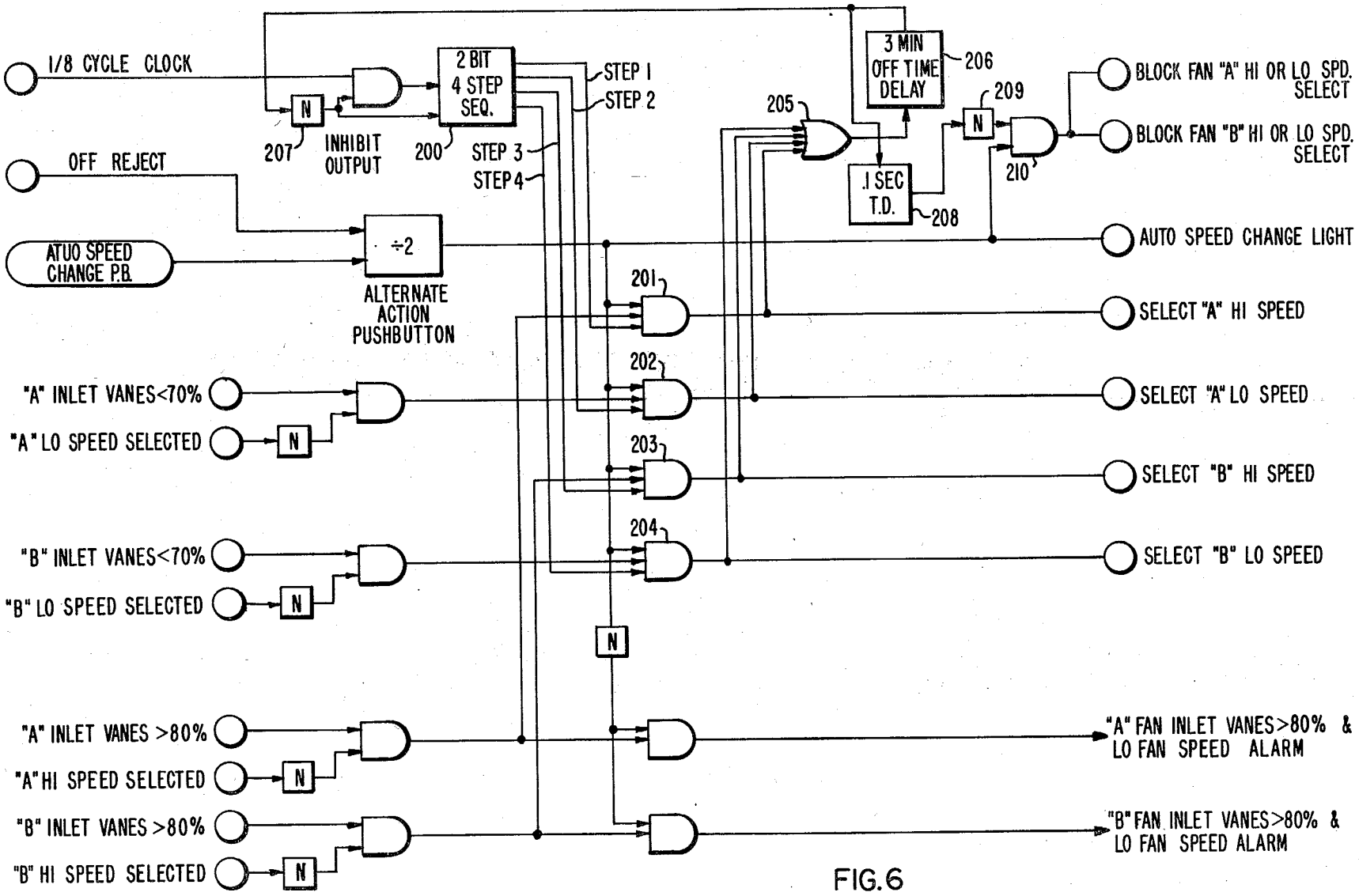
FIG. 6 shows automatic fan speed selection circuitry employed in the illustrative embodiment.

As shown in FIG. 6, a 1/8 cycle clock continuously cycles sequencer 200 to allow only one AND gate 201, 202, 203, or 204 to be operable at any one time. If any fan speed change is required because of the sequencer, only one AND gate can respond at a time on a random basis. Assume it is AND gate 202, "A" Lo Speed would be selected. The AND gate 202 activates the three-minute timer 206 through OR gate 205.

The timer stops the scanning through a NOT block 207 and inhibits output from the scanning sequencer 200 to allow an off time delay timer 206 to reset in three minutes. During the three-minute delay interval, any further fan speed changes within the plant are inhibited.

A 0.1 second time delay 208, NOT block 209, and AND block 210 prevent operator initiated speed changes during the three-minute delay.

Overall, the invention provides for significantly improved operation of boiler processes in which multi-speed fans are employed. Process operation is significantly economized yet smoothness and continuity of boiler air flow and process operation is provided even during fan motor power interruptions required during fan speed changes. The system is generally characterized with self-calibrating operation as fan speed changes are instituted smoothly and automatically on operator or automatic demand.

What is claimed is:

1. A system for operating at least one forced draft fan and/or at least one induced draft fan in a power plant boiler wherein an electric motor is provided to drive each fan, said system comprising speed switching means for operating each motor at least at a low speed and at a high speed, means for controlling the position of inlet vanes associated with each fan to control the boiler air flow and pressure in response to plant load demand, means for sensing inlet vane position, and sequential logic control means for operating said speed switching means to provide orderly and smooth changes in fan speed in response to said inlet vane position sensing means at predetermined vane positions.

2. A system for operating at least one forced draft fan and/or at least one induced draft fan in a power plant boiler wherein an electric motor is provided to drive each fan, said system comprising speed switching means for operating each motor at least at a low speed and at a high speed, means for controlling the position of inlet vanes associated with each fan to control the boiler air flow and pressure in response to plant load demand, means for sensing inlet vane position, and sequential logic control means for operating said speed switching means to provide orderly and smooth changes in fan speed, means for sensing the speed of each fan motor, and feedforward control means responsive to said speed sensing means for modifying the position of the inlet vanes substantially to avoid upsets in air flow or pressure as fan motor speed changes are made.

3. A system for operating at least one forced draft fan and/or at least one induced draft fan in a power plant boiler, said system comprising an electric motor for each fan, speed switching means for operating each motor at least at a low speed and at a high speed, means for controlling the position of inlet vanes associated with each fan to control the boiler air flow and pressure in response to plant load demand, means for sensing inlet vane position, and sequential logic control means for operating said speed switching means to provide orderly and smooth changes in fan speed in response to said inlet vane position sensing means at predetermined vane positions.

4. A system as set forth in claim 1 wherein said sequential logic control means includes a plurality of sequential blocks each of which generates predetermined outputs which define a particular state in the sequence and further is responsive to predetermined process conditions which must be satisfied to trigger advance of the sequence to the next state block,thereby characterizing the system as being self-calibrated.

5. A system for operating two or more induced draft fans in a power plant boiler wherein an electric motor is provided to drive each fan, said system comprising speed switching means for operating each motor at least at a low speed and at a high speed, means for controlling the position of inlet vanes associated with each fan to control the boiler air flow and pressure in response to plant load demand, means for sensing inlet vane position, sequential logic control means for operating said speed switching means to provide orderly and smooth changes in fan speed, balance means for responding to said vane position sensing means to operate said vane position controlling means so that the inlet vane positions for the forced draft fans or the induced draft fans are equalized, and means for offsetting said balance means to allow the inlet vanes of the forced draft fans or the induced draft fans to be at different positions when the forced draft fans are at different speeds or the induced draft fans are at different speeds.

6. A system as set forth in claim 2 wherein means are provided for limiting the range of outputs from said speed sensing means to a normal operating range so as to avoid process upsets otherwise causable by a failure of said speed sensing means.

7. A system for operating at least one forced draft fan and/or at least one induced draft fan in a power plant boiler wherein an electric motor is provided to drive each fan, said system comprising speed switching means for operating each motor at least at a low speed and at a high speed, means for controlling the position of inlet vanes associated with each fan to control the boiler air flow and pressure in response to plant load demand, means for sensing inlet vane position, and sequential logic control means for operating said speed switching means to provide orderly and smooth changes in fan speed in response to said inlet vane position sensing means at predetermined vane positions, said sequential logic control means including a plurality of sequential blocks each of which generates particular outputs which define a particular state in the sequence and further is responsive to predetermined logic inputs which must be satisfied to advance the sequence from block to block, and means for automatically coupling said sequential logic means in sequence to the respective motor speed switching means in accordance with inlet vane position demands for fan speed changes so that the speed of only one motor is changed at any one time.

8. A system for operating at least one forced draft fan and/or at least one induced draft fan in a power plant boiler wherein an electric motor is provided to drive each fan, said system comprising speed switching means for operating each motor at least at a low speed and at a high speed, means for controlling the position of inlet vanes associated with each fan to control the boiler air flow and pressure in response to plant load demand, means for sensing inlet vane position, sequential logic control means for operating said speed switching means to provide orderly and smooth changes in fan speed, said sequential logic control means including a plurality of sequential blocks each of which generates particular outputs which define a particular state in the sequence and further is responsive to predetermined logic inputs which must be satisfied to advance the sequence from block to block, said blocks including a first series of blocks which operate said speed switching means to sequence the fan motor from a stop condition to low speed on startup, and a second series of blocks which operate said speed switching means to sequence the fan motor from a stop condition to high speed on startup.

9. A system as set forth in claim 8 wherein said first series of blocks includes a plurality of blocks which operate said speed switching means to sequence the fan motor from low speed to high speed on demand for a speed change from low to high.

10. A system for operating at least one forced draft fan and/or at least one induced draft fan in a power plant boiler wherein an electric motor is provided to drive each fan, said system comprising speed switching means for operating each motor at least at a low speed and at a high speed, means for controlling the position of inlet vanes associated with each fan to control the boiler air flow and pressure in response to plant load demand, means for sensing inlet vane position, sequential logic control means for operating said speed switching means to provide orderly and smooth changes in fan speed, said sequential logic control means including a plurality of sequential blocks each of which generates particular outputs which define a particular state in the sequence and further is responsive to predetermined logic inputs which must be satisfied to advance the sequence from block to block, said blocks including a first series of blocks which operate said speed switching means to sequence the fan motor from a stop condition to low speed on startup, said first series of blocks including a plurality of blocks which operate said speed switching means to sequence the fan motor from low speed to high speed on demand for a speed change from low to high, another series of blocks operating said speed switching means to sequence the fan motor from high speed to low speed on demand for a speed change from high to low, one of the blocks in said other series of blocks holding the motor deenergized for coastdown to low speed once said speed switching means has been selected for low speed motor operation.

11. A system for operating at least one forced draft fan and/or at least one induced draft fan in a power plant boiler wherein an electric motor is provided to drive each fan, said system comprising speed switching means for operating each motor at least at a low speed and at a high speed, means for controlling the position of inlet vanes associated with each fan to control the boiler air flow and pressure in response to plant load demand, means for sensing inlet vane position, sequential logic control means for operating said speed switching means to provide orderly and smooth changes in fan speed, said sequential logic control means including a plurality of sequential blocks each of which generates particular outputs which define a particular state in the sequence and further is responsive to predetermined logic inputs which must be satisfied to advance the sequence from block to block, said blocks including a first series of blocks which operate said speed switching means to sequence the fan motor from a stop condition to low speed on startup, said first series of blocks including a plurality of blocks which operate said speed switching means to sequence the fan motor from low speed to high speed on demand for a speed change from low to high, another series of blocks operating said speed switching means to sequence the fan motor from high speed to low speed on demand for a speed change from high to low, said first and other series of blocks including means for briefly pausing the sequence to block normal boiler fan trip action and to activate an ultra low speed motor trip before the motor is stopped on a speed change from low to high or high to low, and means for holding the sequence with the motor deenergized for a predetermined delay as said speed switching means is operated on a speed change from low to high or high to low.

12. A system as set forth in claim 11 wherein means are provided for aborting a speed change attempt and returning the sequence to a sequence block which defines the existing motor speed if required actions do not occur during a pause or hold period.

13. A system as set forth in claim 8 wherein means are provided for generating logic outputs which hold the fan vanes closed during the motor startup portion of the sequence.

14. A system as set forth in claim 8 wherein means are provided for resetting said sequential logic control means to an off status on demand to any block in the sequence.

15. A system for operating at least one forced draft fan and/or at least one induced draft fan in a power plant boiler wherein an electric motor is provided to drive each fan, said system comprising speed switching means for operating each motor at least at a low speed and at a high speed, means for controlling the position of inlet vanes associated with each fan to control the boiler air flow and pressure in response to plant load demand, means for sensing inlet vane position, sequential logic control means for operating said speed switching means to provide orderly and smooth changes in fan speed, said sequential logic control means including a plurality of sequential blocks each of which generates particular outputs which define a particular state in the sequence and further is responsive to predetermined logic inputs which must be satisfied to advance the sequence from block to block, said blocks including a first series of blocks which operate said speed switching means to sequence the fan motor from low speed to high speed on demand for a speed change from low to high, another series of blocks operating said speed switching means to sequence the fan motor from high speed to low speed on demand for a speed change from high to low, means for sensing the speed of each fan motor, and means for inhibiting the sequence from advancing motor speed from low to high or high to low unless the existing motor speed is truly indicated by said speed sensing means.

* * * * *